US011466503B2

(12) United States Patent
Tang et al.

(10) Patent No.: US 11,466,503 B2
(45) Date of Patent: Oct. 11, 2022

(54) NUT LEADSCREW TYPE AUTOMATIC DOOR OPENING AND CLOSING MECHANISM, AUTOMOBILE AUTOMATIC DOOR AND AUTOMOBILE

(71) Applicant: Winbo-Dongjian Automotive Technology Co., Ltd., Foshan (CN)

(72) Inventors: Weihang Tang, Foshan (CN); Jingui Rao, Foshan (CN); Yonglin Liao, Foshan (CN); Fei Deng, Foshan (CN); Yincai Ma, Foshan (CN)

(73) Assignee: Winbo-Dongjian Automotive Technology Co., Ltd., Foshan (CN)

( * ) Notice: Subject to any disclaimer, the term of this patent is extended or adjusted under 35 U.S.C. 154(b) by 0 days.

(21) Appl. No.: 17/049,295

(22) PCT Filed: Aug. 2, 2019

(86) PCT No.: PCT/CN2019/099114
§ 371 (c)(1),
(2) Date: Oct. 20, 2020

(87) PCT Pub. No.: WO2020/113983
PCT Pub. Date: Jun. 11, 2020

(65) Prior Publication Data

US 2021/0238907 A1 Aug. 5, 2021

(30) Foreign Application Priority Data

Dec. 5, 2018 (CN) ..... 201811480394.X

(51) Int. Cl.
*E05F 15/00* (2015.01)
*E05F 15/622* (2015.01)

(52) U.S. Cl.
CPC ..... *E05F 15/622* (2015.01); *E05Y 2201/21* (2013.01); *E05Y 2201/216* (2013.01);
(Continued)

(58) Field of Classification Search
CPC ..... E05F 15/622; E05F 15/70; E05F 15/619; E05Y 2201/21; E05Y 2201/216;
(Continued)

(56) References Cited

U.S. PATENT DOCUMENTS 3,398,484 A 8/1968 Katsumura
9,534,436 B2 1/2017 Osafune
(Continued)

FOREIGN PATENT DOCUMENTS

CN 106481183 A 3/2017
CN 206144352 U 5/2017
(Continued)

OTHER PUBLICATIONS

International Search Report for Application No. PCT/CN2019/099114, dated Oct. 23, 2019, 11 pages.
(Continued)

*Primary Examiner* — Chi Q Nguyen
(74) *Attorney, Agent, or Firm* — Seyfarth Shaw LLP

(57) ABSTRACT

A nut leadscrew type automatic door opening and closing mechanism for moving a door of a motor vehicle relative to a vehicle body. The nut leadscrew type automatic door opening and closing mechanism includes a driving device, a leadscrew, a nut pushing block and a pushing rod. The driving device is fixedly connected to a door, the leadscrew is rotatably mounted on the door, the nut pushing block is sleeved on the leadscrew, a first end of the pushing rod is hinged to the nut pushing block, and a second end of the pushing rod is hinged to the vehicle body. The driving device is capable of driving the leadscrew to rotate, so as to allow the nut pushing block and the pushing rod to be reciprocally linearly movable along the leadscrew to allow the pushing rod to drive the door to open or close relative to the vehicle body.

17 Claims, 5 Drawing Sheets

(52) U.S. Cl.
CPC ... *E05Y 2201/224* (2013.01); *E05Y 2201/686* (2013.01); *E05Y 2201/70* (2013.01); *E05Y 2201/702* (2013.01); *E05Y 2600/626* (2013.01); *E05Y 2900/531* (2013.01)

(58) Field of Classification Search
CPC ..... E05Y 2900/531; E05Y 2201/434; E05Y 2900/716; E05Y 2201/70; E05Y 2201/722; E05Y 2600/32; E05Y 2201/704; E05Y 2201/702; B60J 5/047; F16H 1/28
USPC ..... 49/280, 348, 349, 350
See application file for complete search history.

(56) References Cited

U.S. PATENT DOCUMENTS

| | | | | |
|---|---|---|---|---|
| 2007/0022664 | A1 | 2/2007 | Maehoenen et al. | |
| 2009/0107050 | A1* | 4/2009 | Suzuki | E05F 15/603 49/324 |
| 2014/0352216 | A1* | 12/2014 | Kapustnyk | E05B 81/10 49/31 |
| 2015/0376929 | A1* | 12/2015 | Scheuring | F16D 43/21 74/89.38 |
| 2018/0223583 | A1* | 8/2018 | Podkopayev | F16H 25/20 |
| 2019/0128323 | A1* | 5/2019 | Scheuring | F16F 7/08 |
| 2020/0123830 | A1* | 4/2020 | Scheuring | E05F 15/622 |

FOREIGN PATENT DOCUMENTS

| | | | |
|---|---|---|---|
| CN | 206309195 | U | 7/2017 |
| CN | 108590419 | A | 9/2018 |
| CN | 109281568 | A | 1/2019 |
| EP | 1767439 | A2 | 3/2007 |
| JP | H0776974 | | 3/1995 |
| JP | 2003253960 | A | 9/2003 |
| JP | 2004175211 | A | 6/2004 |
| JP | 2014524997 | A | 9/2014 |
| WO | 0200459 | A2 | 1/2002 |
| WO | 2017186229 | A1 | 11/2017 |

OTHER PUBLICATIONS

Japanese Office Action for corresponding Application No. 2021-532075 dated May 24, 2022, 4 pages.
Communication pursuant to Rule 114(2) EPC for corresponding Application No. 19892366.6 dated Jun. 2, 2022, 1 page.
Third Party Observations for corresponding Application No. 19892366.6 dated May 19, 2022, 8 pages.
European Search Report for corresponding Application No. 19892366.6 dated Jul. 22, 2022, 8 pages.

* cited by examiner

NUT LEADSCREW TYPE AUTOMATIC DOOR OPENING AND CLOSING MECHANISM, AUTOMOBILE AUTOMATIC DOOR AND AUTOMOBILE

CROSS REFERENCE TO RELATED APPLICATIONS

This is a U.S. National Stage application of, and claims priority to, PCT/CN2019/099114, filed Aug. 2, 2019, which further claims priority to Chinese Patent Application No. 2018/1480394.X, filed Dec. 5, 2018, the disclosures of which are incorporated herein by reference in their entirety.

TECHNICAL FIELD

The present disclosure relates to the field of automobile technology, and in particular to a nut leadscrew type automatic door opening and closing mechanism, an automobile automatic door and an automobile.

BACKGROUND

Currently, the automation and intelligence of automobiles have become the mainstream of automobile development. The technology of automatic opening and closing of automobile door has a strong appeal and a sense of technology for users, at the same time, it also has a high practicability, which greatly facilitates the owner of the automobile for their daily use. Therefore, there is a great market demand for the modification and upgrade of automobile door. The traditional automobile automatic door opening and closing mechanisms mostly employ four link mechanisms, which have low efficiency, need a large space, and have a high requirement for the installation of the door, thereby limiting the intelligent upgrade and modification of the door.

SUMMARY

Based on the above, it is necessary to provide a nut leadscrew type automatic door opening and closing mechanism, an automobile automatic door and an automobile for solving the problems that the conventional automobile automatic door opening and closing mechanism has low efficiency and needs a large occupied space.

A nut leadscrew type automatic door opening and closing mechanism includes a driving device, a leadscrew, a nut pushing block, and a pushing rod, wherein the driving device is fixedly connected to a door, the leadscrew is rotatably mounted on the door, the nut pushing block is sleeved on the leadscrew, a first end of the pushing rod is hinged to the nut pushing block, a second end of the pushing rod is hinged to a main body, the driving device is capable of driving the leadscrew to rotate, so as to allow the nut pushing block and the pushing rod to be reciprocally linearly movable along the leadscrew, and then allow the pushing rod to drive the door to open or close relative to the main body.

The above-mentioned nut leadscrew type automatic door opening and closing mechanism can realize automatic opening and closing of an automobile door by the cooperation of the driving device, the leadscrew, the nut pushing block and the pushing rod. Specifically, the door and the main body are connected by a door hinge, and the pushing rod and a side of the main body are connected through a pushing rod hinge. During opening or closing the door, the leadscrew is driven by the driving device to rotate so that the nut pushing block can be reciprocally linearly movable along the leadscrew, and then an axial force is generated. The axial force acts on the pushing rod via the nut pushing block, and finally acts on the hinge between the pushing rod and the side of the main body via the pushing rod. Therefore, a reaction force opposite to the axial force is generated from the side of the main body, and it acts on the door along the pushing rod. Since the reaction force does not pass through a rotation center of the door, there is a force arm between the reaction force and the rotation center of the door, so that a rotational moment is generated to drive the door to open or close automatically. At the same time, since a hinge center of the leadscrew is inconsistent with the rotation center of the door, an opening angle of the door is different from a swing angle of the pushing rod. In the above-mentioned nut leadscrew type automatic door opening and closing mechanism, the pushing rod is hinged to the nut pushing block so that the pushing rod can swing relative to the door, thereby ensuring the normal operation of the entire mechanism. The nut leadscrew type automatic door opening and closing mechanism of the present disclosure has the advantages of a simple overall structure, a reliable cooperation, a small occupied space, a small modification to an original automobile door structure, and a high versatility; the engagement of the nut and the leadscrew has a high transmission efficiency, the opening and closing of the door can be realized by using a smaller driving device, so that the nut leadscrew type automatic door opening and closing mechanism can well meet the development requirements of small size and light weight.

In one embodiment, the nut leadscrew type automatic door opening and closing mechanism further includes a bracket fixedly connected to the door, both ends of the leadscrew are rotationally connected to the bracket, the driving device is fixed to the bracket, and the driving device is drivingly connected to the leadscrew.

In one embodiment, the nut pushing block includes a driving portion, a sliding portion, and a hinge shaft; the hinge shaft is located between the driving portion and the sliding portion, and an axis of the hinge shaft is perpendicular to an axis of the leadscrew; the driving portion is sleeved on the leadscrew and screwed with the leadscrew, the sliding portion is slidably connected to the bracket, and the first end of the pushing rod is hinged to the hinge shaft.

In one embodiment, the driving device includes a driving motor and a transmission structure, an axis of an output shaft of the driving motor is parallel to an axis of the leadscrew, and the output shaft of the driving motor is drivingly connected to the leadscrew through the transmission structure.

In one embodiment, the driving motor and the leadscrew are located on the same side of the transmission structure.

In one embodiment, the transmission structure is a gear transmission mechanism, a power input end of the transmission structure is fixedly connected to the output shaft of the driving motor, and a power output end of the transmission structure is fixedly connected to the leadscrew.

In one embodiment, the driving device further includes a brake and/or a clutch, and the brake and/or the clutch is disposed between the driving motor and the transmission structure.

In one embodiment, the pushing rod has a curved portion.

In one embodiment, the pushing rod is provided with a stop portion, and the stop portion is used to limit the rotation of the door.

In one embodiment, an outer peripheral surface of the nut pushing block is provided with a first anti-rotation face, the bracket is provided with a second anti-rotation face, and the first anti-rotation face and the second anti-rotation face are slidably engaged to limit a rotation of the nut pushing block.

In one embodiment, the nut pushing block is connected to the first end of the pushing rod through a spherical hinge.

In one embodiment, the bracket includes a housing portion, and the second anti-rotation face is formed on an inner surface of the housing portion.

In one embodiment, the driving device further includes a rotary damper, which uses its own damping to keep the door hovering.

In one embodiment, the rotary damper is disposed between the driving motor and the transmission structure.

An automobile automatic door includes the nut leadscrew type automatic door opening and closing mechanism as described above.

An automobile includes the automobile automatic door as described above.

REFERENCE SIGNS DESCRIPTION

Figure 1:
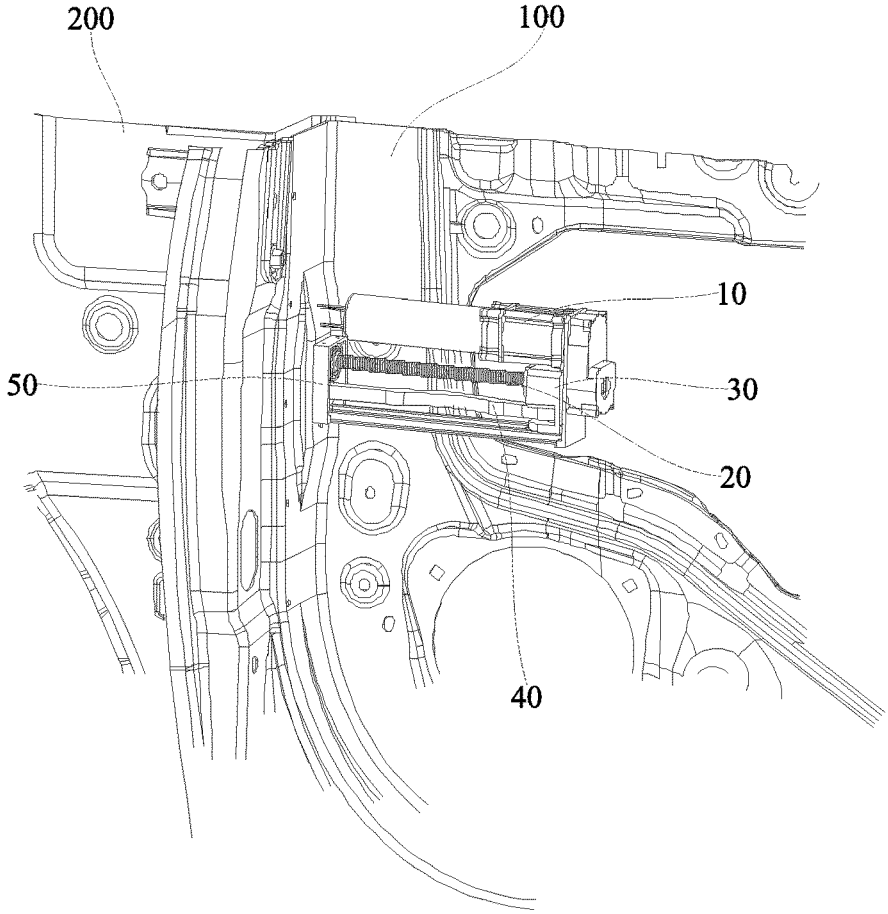
FIG. 1 is a schematic structural view of a nut leadscrew type automatic door opening and closing mechanism according to a first embodiment of the present disclosure.

10 driving device, 11 driving motor, 12 transmission structure, 121 first transmission gear, 122 second transmission gear, 13 brake, 14 clutch, 15 rotary damper, 20 leadscrew, 30 nut pushing block, 301 first anti-rotation face, 31 driving portion, 32 sliding portion, 33 hinge shaft, 40 pushing rod, 41 stop portion, 42 pushing rod hinge, 50 bracket, 51 housing portion, 510 second anti-rotation face, 100 door, 101 door hinge, 200 main body.

DETAILED DESCRIPTION

In order to facilitate understanding of the present disclosure, the present disclosure will be described more fully hereinafter with reference to the accompanying drawings. The drawings show a preferred embodiment of the present disclosure. However, the present disclosure may be implemented in many different forms and is not limited to the embodiments described herein. Rather, these embodiments are provided to provide a thorough understanding of the present disclosure.

It should be noted that when an element is referred to as being "fixed to" (or "fixed connected to" an other element, it may be directly on the other element or fixed to the other element via an intermediate element. When an element is considered to be "connected" to an other element, it can be directly connected to the other element or connected to the other element via an intermediate element. In contrast, when an element is referred to as being "directly on" another element, there is no intermediate element. The terms "first" and "second" in the present disclosure do not represent specific numbers and orders, but are merely used for distinguishing names.

Referring to FIG. 1 to FIG. 4, a first embodiment of a nut leadscrew type automatic door opening and closing mechanism is shown, and it includes a driving device 10, a leadscrew 20, a nut pushing block 30 and a pushing rod 40, the driving device 10 is fixedly connected to a door 100, the leadscrew 20 is rotatably mounted on the door 100, the nut pushing block 30 is sleeved on the leadscrew 20, a first end of the pushing rod 40 is hinged to the nut pushing block 30, a second end of the pushing rod 40 is hinged to a main body 200, the driving device 20 is capable of driving the leadscrew 20 to rotate, so as to allow the nut pushing block 30 and the pushing rod 40 to be reciprocally linearly movable along the leadscrew 20, and then allow the pushing rod 40 to drive the door 100 to open or close relative to the main body 200.

The nut leadscrew type automatic door opening and closing mechanism can be applied to automatic opening and closing of an automobile door, and of course, it can also be applied to automatic opening and closing of doors of other devices. The following mainly describes the application of the nut leadscrew type automatic door opening and closing mechanism on the automobile door. Specifically, the door 100 is connected to a side of the main body 200 by a door hinge 101, and then the door 100 can be rotatable relative to the main body 200. The driving device 10 and the leadscrew 20 can be directly mounted on the door 100 or mounted on the door 100 through a bracket 50. The leadscrew 20 can be rotatable around its own axis under the driving of the driving device 10. The nut pushing block 30 has a spiral line inside, and it is screwed with the leadscrew 20 to form a leadscrew and nut pair. A spiral transmission between the nut pushing block 30 and the leadscrew 20 may be a sliding spiral transmission, a rolling spiral transmission or a static pressure spiral transmission.

Figure 4:
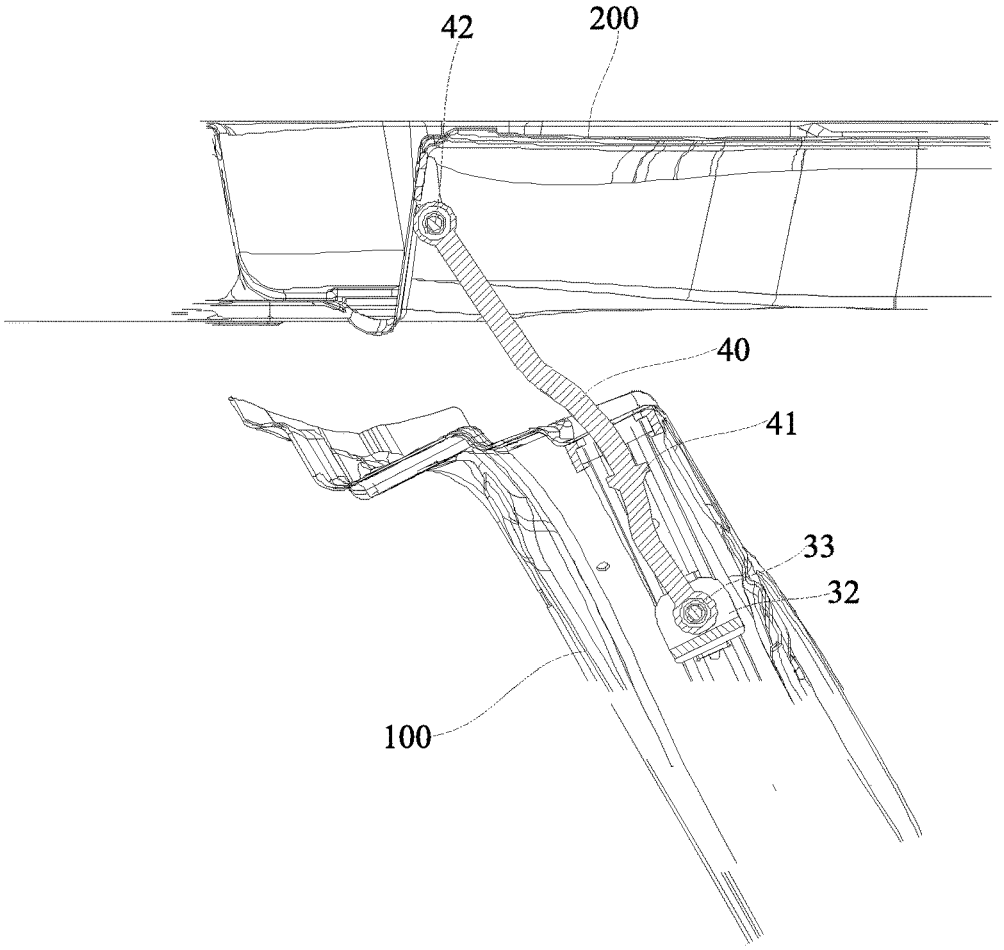
FIG. 4 is a schematic partial sectional view of the nut leadscrew type automatic door opening and closing mechanism in FIG. 1 in a top view state.

The first end of the pushing rod 40 is hinged to the nut pushing block 30, and the second end is hinged to the side of the main body 200 through the pushing rod hinge 42. In this way, when the nut pushing block 30 drives the pushing rod 40 to move, the pushing rod 40 can swing relative to the door 100 for its adaptive adjustment, thereby ensuring the normal operation of the entire mechanism. As can be seen from FIG. 5, a rotation center of the pushing rod hinge 42 does not coincide with a rotation center of the door hinge 101. As an example, the virtual lines, connecting a hinge point formed by the pushing rod hinge 101, a hinge point formed by the door hinge 101, and a hinge point formed by the hinge between the pushing rod 40 and the nut pushing block 30, form a triangle shape which changes its shape along with the door 100 swings. The specific shape of the pushing rod 40 can be designed according to its motion trajectory. For example, as shown in FIG. 4, the pushing rod 40 can be designed as a curved type pushing rod with a certain radian. During opening and closing the door 100, the pushing rod 40 can avoid other structures on the door 100 through its own shape to prevent interference with the door 100, thereby reducing structural changes to the door 100 and realizing non-destructive modification and upgrade of the door 100, making the nut leadscrew type automatic door opening and closing mechanism more versatile.

In case that the hinges may be not parallel to each other due to insufficient processing accuracy and/or assembly error, in order to ensure the smooth movement of the nut leadscrew mechanism and allow the door 100 to be opened and closed smoothly, the engagement of each hinge can adopt a spherical pair. In addition, the nut leadscrew type automatic door opening and closing mechanism further includes a control unit electrically connected to the driving device 10, and the control unit is used to control the running and stopping of the driving device 10.

The above-mentioned nut leadscrew type automatic door opening and closing mechanism can realize automatic opening and closing of an automobile door by the cooperation of the driving device 10, the leadscrew 20, the nut pushing block 30 and the pushing rod 40. Specifically, during opening or closing the door 100, the leadscrew 20 is driven by the driving device 10 to rotate so that the nut pushing block 30 can be reciprocally linearly movable along the leadscrew 20, and then an axial force is generated. The axial force acts on the pushing rod 40 via the nut pushing block 30, and finally acts on the hinge between the pushing rod 40 and the side of the main body 200 via the pushing rod 40. Therefore, a reaction force opposite to the axial force is generated from the side of the main body 200, and it acts on the door 100 along the pushing rod 40. Since the reaction force does not pass through a rotation center of the door 100, there is a force arm between the reaction force and the rotation center of the door 100, so that a rotational moment is generated to drive the door 100 to open or close automatically. At the same time, since the hinge a center of the pushing rod 40 is inconsistent with the rotation center of the door 100, an opening angle of the door 100 is different from a swing angle of the pushing rod 40. The above-mentioned nut leadscrew type automatic door opening and closing mechanism uses the pushing rod 40 to be hinged to the nut pushing block 30 so that the pushing rod 40 can swing relative to the door 100, thereby ensuring the normal operation of the entire mechanism. The nut leadscrew type automatic door opening and closing mechanism of the present disclosure has the advantages of a simple overall structure, a reliable cooperation, a small occupied space, a small modification to an original automobile door structure, and a high versatility; the engagement of the nut and the leadscrew has a high transmission efficiency, the opening and closing of the door 100 can be realized by using a smaller driving device 10, so that the nut leadscrew type automatic door opening and closing mechanism can well meet the development requirements of small size and light weight.

As an example, the nut leadscrew type automatic door opening and closing mechanism further includes a bracket 50, the bracket 50 is fixedly connected to the door 100, both ends of the leadscrew 20 are rotationally connected to the bracket 50, the driving device 10 is fixed to the bracket 50 and drivingly connected to the leadscrew 20. In this embodiment, the bracket 50 is provided to facilitate the installation of the driving device 10 and the leadscrew 20, thereby reducing the modification to the structure of the door 100 itself, further improving the versatility. Specifically, both ends of the leadscrew 20 can be rotatably connected to the bracket 50 by bearings or sleeves, and the driving device 10 is drivingly connected to the leadscrew 20 to drive the leadscrew 20 to rotate.

Figure 3:
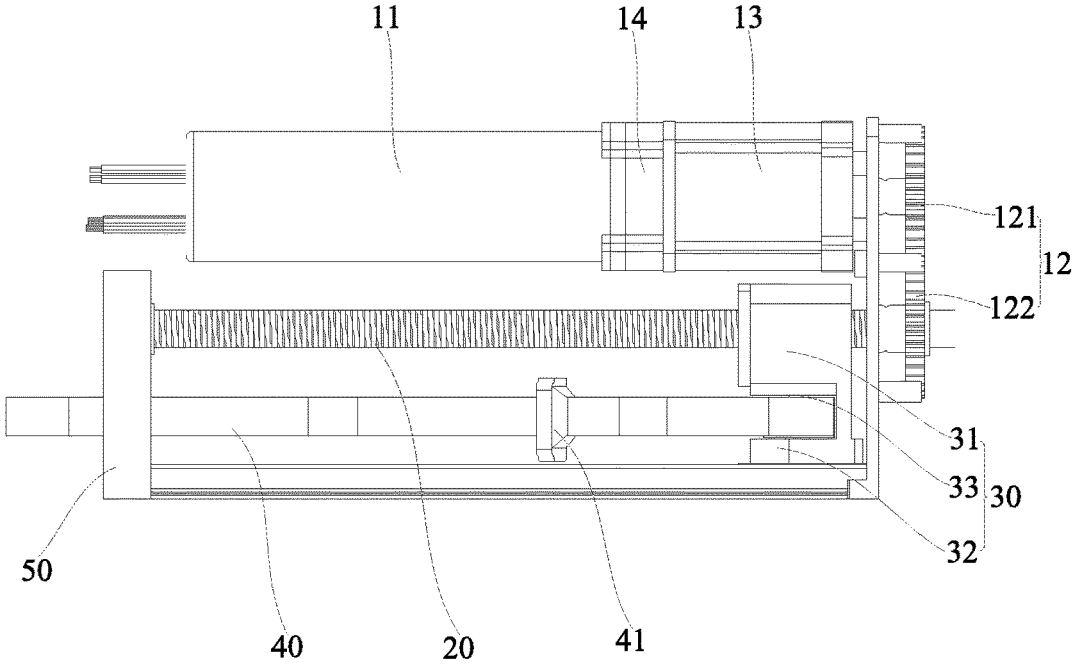
FIG. 3 is a schematic plan view of the nut leadscrew type automatic door opening and closing mechanism in FIG. 1.

As an example, referring to FIG. 3, the nut pushing block 30 includes a driving portion 31, a sliding portion 32, and a hinge shaft 33. The hinge shaft 33 is located between the driving portion 31 and the sliding portion 32, and an axis of the hinge shaft 33 is perpendicular to an axis of the leadscrew 20. The driving portion 31 is sleeved on the leadscrew 20 and screwed with the leadscrew 20. The sliding portion 32 is slidably connected to the bracket 50, to limit the rotation of the nut pushing block 30 relative to the axis of the leadscrew 20. A first end of the pushing rod 40 is hinged to the hinge shaft 33. It can be understood that the rotation of the nut pushing block 30 relative to the axis of the leadscrew 20 can also be limited by other suitable structures, as long as they can ensure that the nut pushing block 30 can perform a reciprocating linear motion along the leadscrew 20 when the screw 20 rotates.

Specifically, the driving portion 31 is provided with a spiral line inside and is screwed with the leadscrew 20. The sliding portion 32 and the bracket 50 can be slidably connected by a sliding structure. For example, the bracket 50 can be provided with a sliding groove extending in a direction parallel to the axis direction of the leadscrew 20, the sliding portion 32 is provided with a sliding block that cooperates with the sliding groove. The cooperation between the sliding groove and the sliding block can also limit the rotation of the nut pushing block 32 relative to the axis of the leadscrew 20. The first end of the pushing rod 40 is sleeved on the hinge shaft 33, so that the pushing rod 40 can swing relative to the hinge shaft 22. The driving device 10 drives the leadscrew 20 to rotate, so as to drive the driving portion 30 to perform a linear motion along the leadscrew 20, then the pushing rod 40 is pushed to move under the action of the hinge shaft 33, and the pushing rod 40 can swing to adjust itself. The sliding connection of the sliding portion 32 and the bracket 50 can also ensure the smoothness and accuracy of the movements of the nut pushing block 30 and the pushing rod 40. This nut leadscrew type transmission mechanism has the advantageous of a compact overall structure, a small occupied space, a reliable cooperation, and a high transmission efficiency.

As an example, the driving device 10 includes a driving motor 11 and a transmission structure 12, an axis of an output shaft of the driving motor 11 is parallel to the axis of the leadscrew 20, and the output shaft of the driving motor 11 is drivingly connected to the leadscrew 20 through the transmission structure 12. Specifically, the driving motor 11 is horizontally placed on a upper side or a lower side of the leadscrew 20, the axis of the output shaft of the driving motor 11 is parallel to the axis of the leadscrew 20, the output shaft of the driving motor 11 is drivingly connected to the leadscrew 20 through the transmission structure 12 so as to transmit torque. As an example, the transmission structure 12 may be a gear transmission mechanism or a timing belt transmission mechanism. As an example, referring to FIG. 3, the driving motor 11 and the leadscrew 20 are located on the same side of the transmission structure 12, so that the driving motor 11 and the leadscrew 20 are arranged side by side. In this way, while ensuring the normal transmission between the driving motor 11 and the leadscrew 20, a occupied space of the driving device 10 in the axis direction of the leadscrew 20 (that is, the lateral direction of the door or the horizontal direction of the door) can be effectively reduced.

As an example, the transmission structure 12 is a two-stage gear transmission mechanism, which includes a first transmission gear 121 and a second transmission gear 122. The first transmission gear 121 is fixedly connected to the output shaft of the driving motor 11, and the second transmission gear 122 is fixedly connected to the leadscrew 20, and the first transmission gear 121 is engaged with the second transmission gear 122. The torque is transmitted through the engagement between the first transmission gear 121 and the second transmission gear 122, so that transmission structure 12 is simple in structure and reliable in cooperation. Of course, in other examples, the transmission structure 12 may also be a multi-stage (more than two-stage) gear transmission mechanism. It can be understood that a power input end of the transmission structure 12 is fixedly connected to the output shaft of the driving motor 11, and a power output end of the transmission structure 12 is fixedly connected to the leadscrew 20, thereby transmitting torque from the driving motor 11 to the leadscrew 20.

As an example, the driving device 10 further includes a brake 13 and/or a clutch 14, and the brake 13 and/or the clutch 14 is disposed between the driving motor 11 and the transmission structure 12.

By disposing the brake 13 between the driving motor 11 and the transmission structure 12, when the driving motor 11 stops, the brake 13 is locked, and the frictional torque of the brake 13 can ensure that the door 100 is hovered at the current position, thereby effectively preventing the door 100 from being unable to maintain at the current position due to inertia effect or other reasons after being opened, thus affecting user experience. When the driving motor 11 drives the leadscrew 20 to rotate, the brake 13 is released, so that the door 100 can rotate normally. In order to achieve a better running effect and ergonomics effect, the brake 13 is preferably an electromagnetic brake. Of course, other forms of brakes 60 or friction devices can also be used, such as a spring brake. It should be noted that, in other examples, the brake 13 and the clutch 14 may also be canceled. For example, the motor reverse brake can be used to provide power for keeping the door hovering, or the static resistance of the motor can be used to keep the door hovering.

Further, due to the friction inside the driving motor 11, when manually opening or closing the door, this friction needs to be overcome to allow the leadscrew 20 to rotate, that is, it is necessary to overcome resistance to manually open or close the door 100, which affects user experience. In order to achieve a better ergonomics effect, a clutch 14 is disposed between the driving motor 11 and the brake 13. When the door is electrically opened or closed, the clutch 14 is in engagement state to transmit the driving force. When it is necessary to enter a manual opening and closing door mode, the clutch 14 is disengaged, and the door 100 can be easily opened or closed manually. The clutch 14 may be a "mechanical one-way transmission clutch" having a small size, or other types of clutches.

Figure 2:
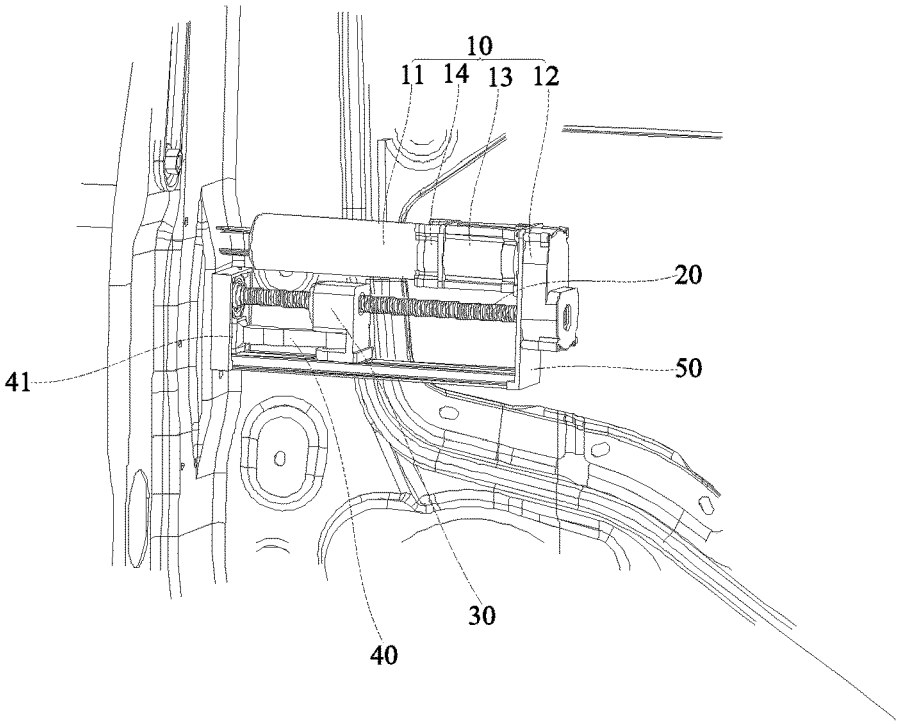
FIG. 2 is a schematic structural view of the nut leadscrew type automatic door opening and closing mechanism in FIG. 1 in another state.

As an example, the pushing rod 40 is provided with a stop portion 41, and the stop portion 41 is used to limit the rotation of the door 100. Specifically, the pushing rod 40 is provided with a stopper 41 in a boss shape. As shown in FIG. 2, when the door 100 is opened to the maximum angle, the stop portion 41 abuts against the structure of the door 100 itself or the bracket 50 to limit the continued opening of the door 100, it plays a role in protecting the door hinge 101, the nut pushing block 30 and the lead screw 20, and prevents the door 100 from opening too much, which may cause an impact on the door hinge 101, the nut pushing block 30, and the leadscrew 20.

The present disclosure also provides an automobile automatic door, which comprises the nut leadscrew type automatic door opening and closing mechanism as described above, and the specific structure of the nut leadscrew type automatic door opening and closing mechanism can refer to the above embodiment. Since the automobile automatic door adopts all the technical solutions of the above embodiments, and thus at least includes all the beneficial effects brought by the above embodiments, and will not be described in detail herein.

The opening and closing actions of the automobile automatic door using the nut leadscrew type automatic door opening and closing mechanism according to the first embodiment of the present disclosure will be described in detail below with reference to FIGS. 5 and 6, taking a primary driver door as example.

Figure 5:
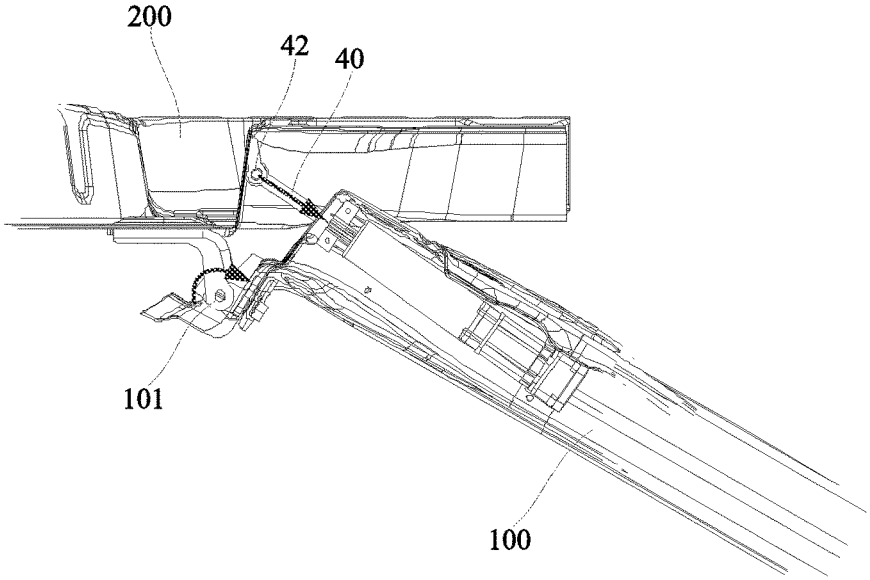
FIG. 5 is a schematic view of the nut leadscrew type automatic door opening and closing mechanism in FIG. 1 when it drives a door to open.

Referring to FIG. 5, when the driving device 10 receives an ECU instruction "open the door", the driving device 10 drives the leadscrew 20 to rotate in a first direction, the nut leadscrew pair consisting of the leadscrew 20 and the nut pushing block 30 generates an axial force in a direction toward the hinge between the leadscrew 40 and the side of the main body 200. This axial force finally acts on the pushing rod hinge 42 via the nut pushing block 30 and the pushing rod 40 (the pushing rod 40 is hinged to the side of the main body 200 through the pushing rod hinge 42). Due to the interaction of the forces, the side of the main body 200 also generates a reaction thrust acting on the door 100 through the pushing rod 40. There is an arm between the axial force transmitted through the pushing rod 40 and the door hinge 101, so a rotational moment is generated to drive the door 100 to rotate to open. During opening the door 100, the nut pushing block 30 moves linearly along the leadscrew 30 toward the front of the automobile; at the same time, the pushing rod 40 swings around the hinge at both ends, making the mechanism run smoothly.

Figure 6:
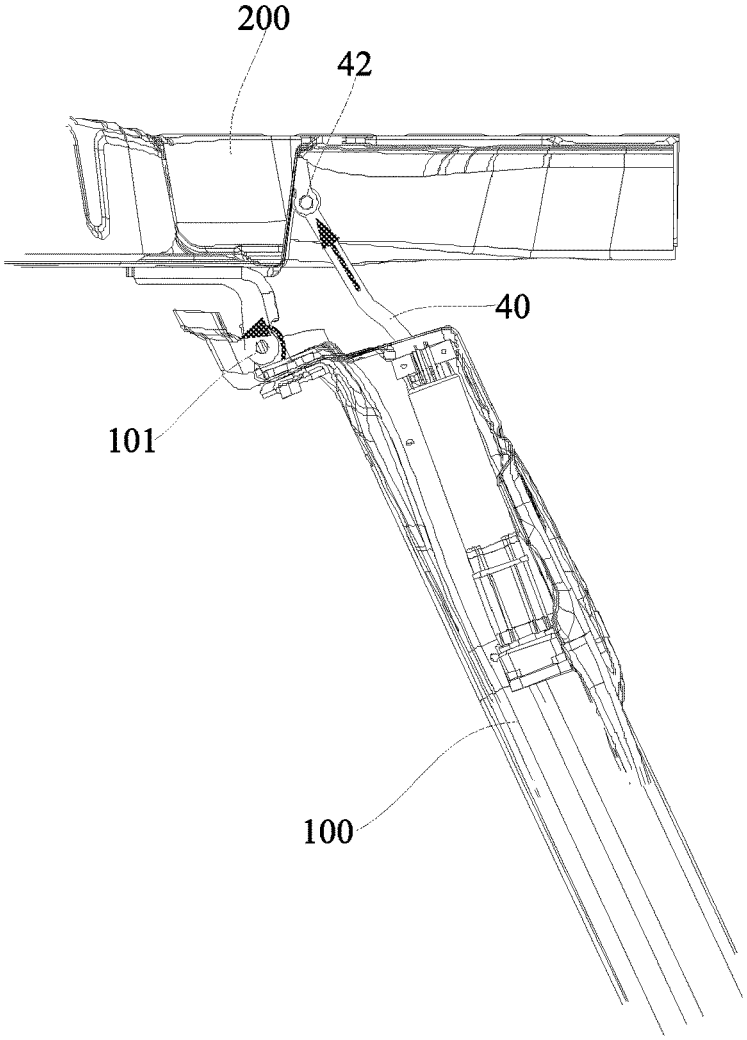
FIG. 6 is a schematic view of the nut leadscrew type automatic door opening and closing mechanism in FIG. 1 when it drives a door to close.

Referring to FIG. 6, when the driving device 10 receives an ECU instruction "close the door", the driving device 10 drives the leadscrew 20 to rotate in a second direction which is opposite to the first direction. The nut leadscrew pair consisting of the leadscrew 20 and the nut pushing block 30 generates an axial force in a direction away from the hinge between the leadscrew 40 and the side of the main body 200, and the side of the main body 200 generates a reaction tension, and the reaction tension generates a rotational moment to the door 100 so as to drive the door 100 to rotate to close.

Figure 7:
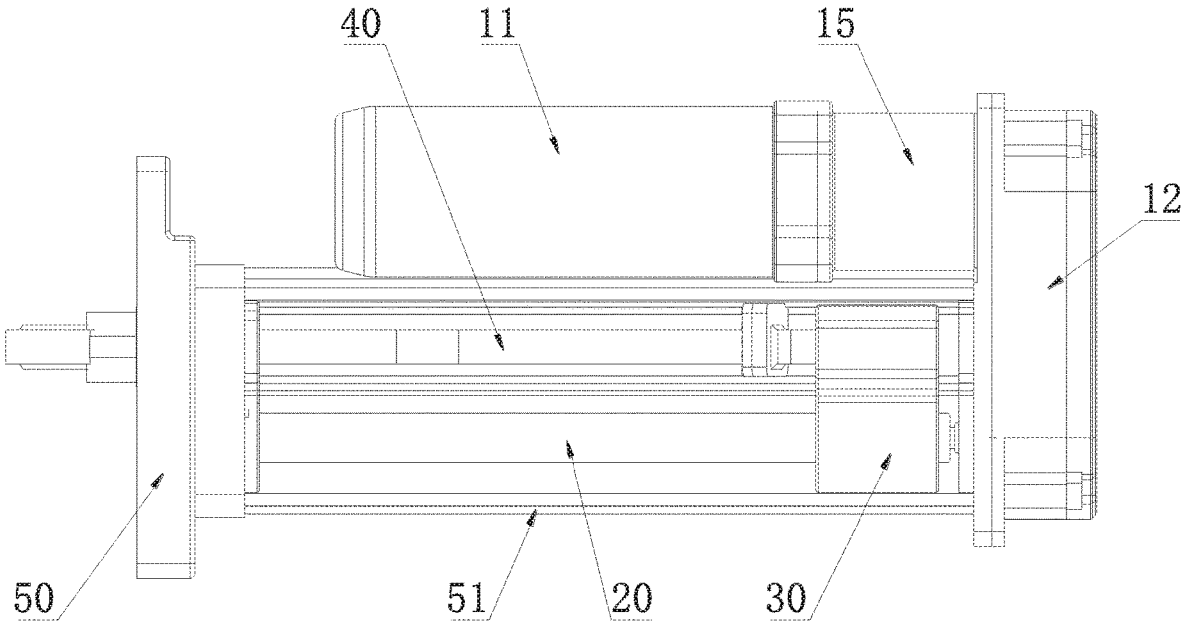
FIG. 7 is a schematic structural view of a nut leadscrew type automatic door opening and closing mechanism according to a second embodiment of the present disclosure.
Figure 8:
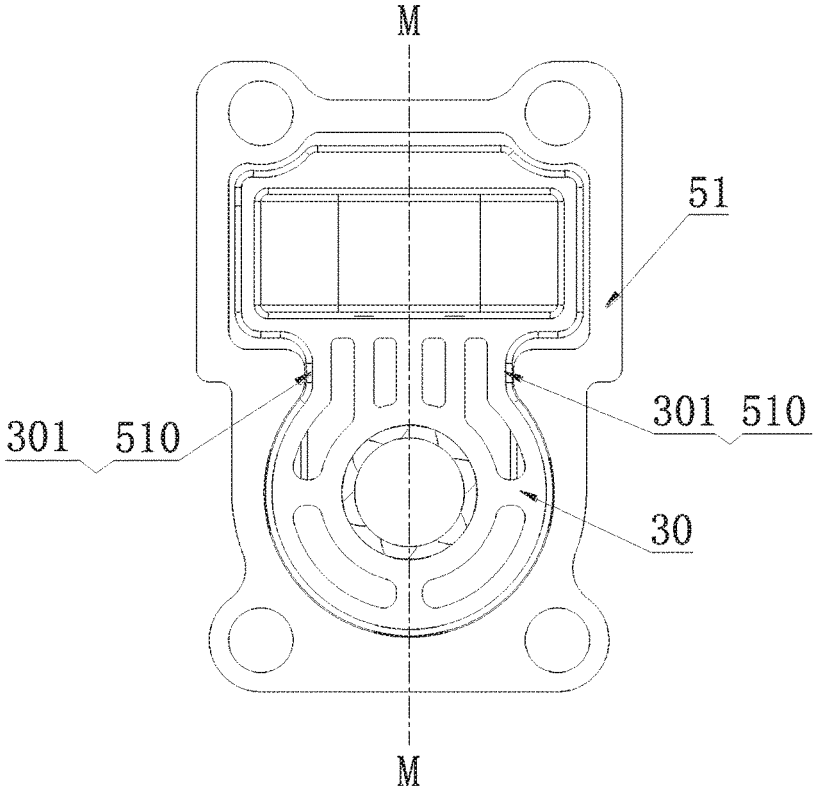
FIG. 8 schematically illustrates a side view of a nut pushing block and a housing portion in the second embodiment of the present disclosure.
Figure 9:
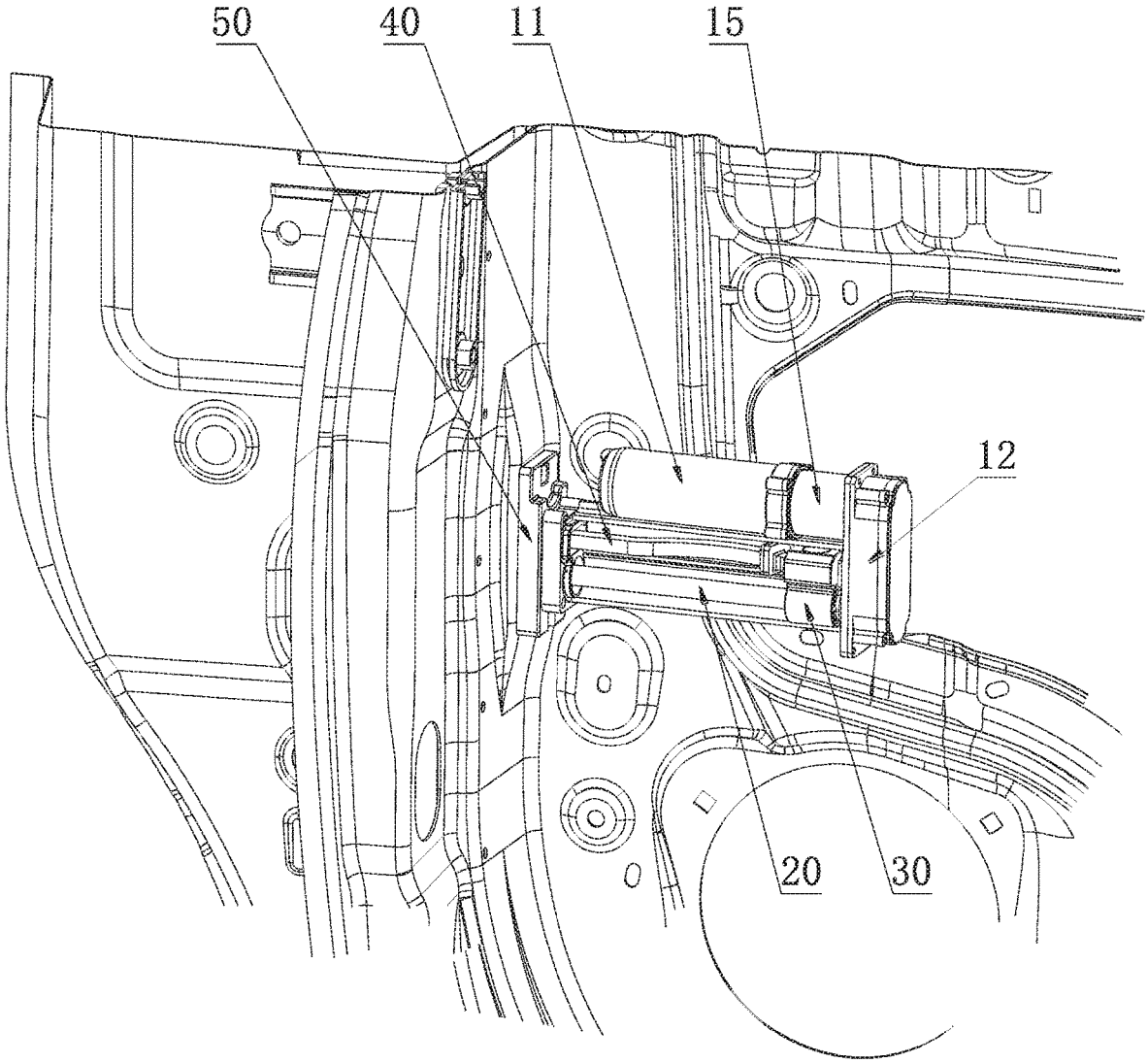
FIG. 9 is a schematic perspective view of a partial structure of the nut leadscrew type automatic door opening and closing mechanism according to the second embodiment of the present disclosure when it is applied to an automobile.

Please referring to FIG. 7 to FIG. 9, a second embodiment of the nut leadscrew type automatic door opening and closing mechanism is shown. The main differences between the second embodiment and the above-mentioned first embodiment include: the specific structure adopted for the linear reciprocating motion of the nut pushing block 30 along the leadscrew 20, and the specific implementation adopted for controlling the hovering position of the door.

In this embodiment, the nut pushing block 30 uses its own shape to form a sliding cooperation with the bracket 50, so that the nut pushing block 30 can perform a linear reciprocating motion along the axial direction of the leadscrew 20 without rotating around the axis of the leadscrew 20. Specifically, an outer peripheral surface of the nut pushing block 30 is provided with a first anti-rotation face 301, the bracket 50 is provided with a second anti-rotation face 510, and the first anti-rotation face 301 and the second anti-rotation face 510 are slidably engaged to limit a rotation of the nut pushing block 30. As an example, the nut pushing block 30 is provided with two first anti-rotation faces 310 spaced apart, and the two first anti-rotation faces 301 are preferably disposed symmetrically about the longitudinal axis M-M in FIG. 8. The bracket 50 is provided with two second anti-rotation faces 510, the two second anti-rotation faces 510 correspond one-to-one with the two first anti-rotation faces 301. This configuration facilitates smooth motion of the nut pushing block 30. As an example, the bracket 50 includes a housing portion 51, and the second anti-rotation surface 510 is formed on an inner surface of the housing portion facing the nut pushing block 30.

In addition, in order to increase the hovering limit of the door and reduce the electric power consumption of the nut leadscrew type automatic door opening and closing mechanism, in this embodiment, a rotary damper 15 is added to the driving device 10, and the rotary damper 15 uses its own damping to keep the door 100 hovering. The damper 15 may be a friction-plate type mechanical rotary damper, a hydraulic rotary damper, or other friction devices. The damper 15 may be disposed between the driving motor 11 and the transmission structure 12, or inside the transmission structure 12, or between the leadscrew 20 and the transmission structure 12, as long as it can finally limit the rotation of the leadscrew 20. As an example, referring to FIG. 7 and FIG. 9, the rotary damper 15 is disposed between the driving motor 11 and the transmission structure 12 in this embodiment.

In combination with related technology, it can be known that the rotary damper 15 is generally provided with a rotating portion and a fixed portion, wherein the fixed portion remains stationary, the rotating portion and a torque transmitting shaft (for example, an output shaft of the drive motor 11 or a power input shaft of the transmission structure 12, or a power output shaft of the transmission structure 12) are non-rotatably connected. The rotating part and the fixed part are frictionally connected to each other. For example, a friction-plate type mechanical rotary damper uses the interaction between its friction plates, or a hydraulic rotary damper uses the low flow resistance characteristics of its internal hydraulic oil, so that when the above-mentioned rotating part is rotated, it is necessary to overcome the friction between the rotating part and the fixed part of the rotary damper. This friction limits the movement of the pushing rod 40 and the leadscrew 20, thereby ensuring the hovering of the door.

It should be noted that, in the case without conflict, the structure of other aspects of the second embodiment of the present application may be the same as or similar to that of other aspects of the first embodiment of the present application. For example, the pushing rod 40 may have a curved portion, the pushing rod 40 is provided with a stop portion 41, and the transmission structure 12 is a gear transmission mechanism or other type transmission mechanism. The process of opening and closing the automobile automatic door to which the nut leadscrew type automatic door opening and closing mechanism of the second embodiment of the present application is applied is substantially the same as that described in the first embodiment, and will not be described in detail herein.

The present disclosure also provides an automobile including the automobile automatic door as described above, the automobile automatic door comprises the nut leadscrew type automatic door opening and closing mechanism as described above, and the specific structure of the nut leadscrew type automatic door opening and closing mechanism can refer to the above embodiment. Since the automobile automatic door adopts all the technical solutions of the above embodiments, and thus at least includes all the beneficial effects brought by the above embodiments, which will not be described in detail herein. It can be understood that, based on factors such as the weight and quantity of the door, multiple sets of nut leadscrew type automatic door opening and closing mechanisms of the present application can be used in one automobile.

All of the technical features in the above embodiments may be employed in arbitrary combinations. For purpose of simplifying the description, not all arbitrary combinations of the technical features in the above embodiments are described. However, as long as such combinations of the technical features are not contradictory, they should be considered as within the scope of the disclosure in this specification.

The above embodiments merely represent several embodiments of the present disclosure, and the description thereof is more specific and detailed, but they should not be construed as limiting the scope of the disclosure. It should be noted that for those skilled in the art, several variations and improvements may be made without departing from the concept of the present disclosure. And these are all within the protection scope of the present disclosure. Therefore, the scope of protection of the present disclosure shall be subject to the appended claims.

What is claimed is:

1. A nut leadscrew type automatic door opening and closing mechanism for moving a door of a motor vehicle relative to a vehicle body, comprising:

a driving device adapted to couple to the door;

a leadscrew adapted to be rotatably coupled to the door;

a nut pushing block sleeved on the leadscrew; and a pushing rod having first and second ends, wherein the first end is hinged to the nut push block, and the second end is adapted to be hinged to the vehicle body, and wherein the driving device is adapted to drive the leadscrew to rotate to allow the nut pushing block and the pushing rod to be reciprocally linearly movable along the leadscrew, thereby allowing the pushing rod to drive the door between opened and closed positions relative to the vehicle body.

2. The nut leadscrew type automatic door opening and closing mechanism according to claim 1, further comprising a bracket fixedly coupled to the door, wherein the leadscrew includes first and second opposing ends that are rotationally coupled to the bracket, and wherein the driving device is coupled to the bracket and is drivingly coupled to the leadscrew.

3. The nut leadscrew type automatic door opening and closing mechanism according to claim 2, wherein the nut pushing block includes a driving portion, a sliding portion and a hinge shaft;

wherein the hinge shaft is located between the driving portion and the sliding portion, and an axis of the hinge shaft is perpendicular to an axis of the leadscrew;

wherein the driving portion is sleeved on the leadscrew and screwed with the leadscrew, the sliding portion is slidably coupled to the bracket, and the first end of the pushing rod is hinged to the hinge shaft.

4. The nut leadscrew type automatic door opening and closing mechanism according to claim 2, wherein the driving device includes a driving motor and a transmission structure, wherein an axis of an output shaft of the driving motor is parallel to an axis of the leadscrew, and the output shaft of the driving motor is drivingly coupled to the leadscrew by the transmission structure.

5. The nut leadscrew type automatic door opening and closing mechanism according to claim 4, wherein the driving motor and the leadscrew are located on the same side of the transmission structure.

6. The nut leadscrew type automatic door opening and closing mechanism according to claim 4, wherein the transmission structure is a gear transmission mechanism, a power input end of the transmission structure is fixedly coupled to the output shaft of the driving motor, and a power output end of the transmission structure is fixedly coupled to the leadscrew.

7. The nut leadscrew type automatic door opening and closing mechanism according to claim 4, wherein the driving device further includes a brake disposed between the driving motor and the transmission structure.

8. The nut leadscrew type automatic door opening and closing mechanism according to claim 4, wherein the driving device further includes a rotary damper adapted to keep the door from moving relative to the vehicle body.

9. The nut leadscrew type automatic door opening and closing mechanism according to claim 8, wherein the rotary damper is disposed between the driving motor and the transmission structure.

10. The nut leadscrew type automatic door opening and closing mechanism according to claim 4, wherein the driving device further includes a clutch disposed between the driving motor and the transmission structure.

11. The nut leadscrew type automatic door opening and closing mechanism according to claim 2, wherein an outer peripheral surface of the nut pushing block includes a first anti-rotation face, the bracket includes a second anti-rotation face, and the first and second anti-rotation faces are slidably engaged to limit rotation of the nut pushing block.

12. The nut leadscrew type automatic door opening and closing mechanism according to claim 11, wherein the nut pushing block is coupled to the first end of the pushing rod by a spherical hinge.

13. The nut leadscrew type automatic door opening and closing mechanism according to claim 11, wherein the bracket includes a housing portion, and the second anti-rotation face is formed on an inner surface of the housing portion.

14. The nut leadscrew type automatic door opening and closing mechanism according to claim 1, wherein the pushing rod has a curved portion.

15. The nut leadscrew type automatic door opening and closing mechanism according to claim 1, wherein the pushing rod includes a stop portion to limit a rotation of the door.

16. An automobile automatic door, comprising the nut leadscrew type automatic door opening and closing mechanism according to claim 1.

17. An automobile, comprising the automobile automatic door according to claim 16.

* * * * *